United States Patent [19]

Tsubouchi et al.

[11] Patent Number: 4,808,084

[45] Date of Patent: Feb. 28, 1989

[54] APPARATUS FOR TRANSFERRING SMALL AMOUNT OF FLUID

[75] Inventors: Kuniyoshi Tsubouchi, Mito; Shohei Yoshida, Hitachi; Kiyoshi Namura; Akira Arai, both of Ibaraki, all of Japan

[73] Assignee: Hitachi, Ltd., Tokyo, Japan

[21] Appl. No.: 29,095

[22] Filed: Mar. 23, 1987

[30] Foreign Application Priority Data

Mar. 24, 1986 [JP] Japan ..... 61-64092

[51] Int. Cl.[4] ..... F04B 43/08

[52] U.S. Cl. ..... 417/322; 417/478; 310/328

[58] Field of Search ..... 417/322, 417, 474, 478; 310/328

[56] References Cited

U.S. PATENT DOCUMENTS

| | | | |
|---|---|---|---|
| 3,217,218 | 11/1965 | Steele | 310/328 X |
| 4,012,177 | 3/1977 | Yakich | 417/478 X |
| 4,032,929 | 6/1977 | Fischbeck et al. | 310/328 X |
| 4,344,743 | 8/1982 | Bessman et al. | 417/478 X |
| 4,432,699 | 2/1984 | Beckman et al. | 417/322 X |
| 4,449,893 | 5/1984 | Beckman et al. | 417/332 |
| 4,482,346 | 11/1984 | Reinicke | 417/417 X |
| 4,504,760 | 3/1985 | Yamamoto et al. | 310/328 X |
| 4,626,180 | 12/1986 | Tagawa et al. | 418/88 X |

FOREIGN PATENT DOCUMENTS

| | | | |
|---|---|---|---|
| 55-043258 | 3/1980 | Japan | 417/322 |
| 0374036 | 2/1978 | U.S.S.R. | 310/328 |

*Primary Examiner*—Carlton R. Croyle
*Assistant Examiner*—Eugene L. Szczecina, Jr.
*Attorney, Agent, or Firm*—Antonelli, Terry & Wands

[57] ABSTRACT

An apparatus for transferring a small amount of fluid has at least three vibration pump units which are connected in series. Each vibration pump unit has a fluid transfer pipe, a vibrator mounted on the outer peripheral surface of the fluid transfer pipe and adapted to cause the transfer pipe to vibrate in a respiring manner, an inner peripheral electrode on the inner peripheral surface of the vibrator, an outer peripheral electrode on the outer peripheral surface of the vibrator, a high-frequency voltage applying device for applying a high-frequency voltage between the inner peripheral electrode and the outer peripheral electrode thereby causing the vibrator to vibrate in respiring manner, and a fluid diode exhibiting resistance to reversing of the fluid and connected to the fluid outlet of the fluid transfer pipe in such a manner as to permit the fluid to be discharged from the fluid pipe. The adjacent vibration pumps operate with a predetermined phase difference therebetween.

10 Claims, 6 Drawing Sheets

APPARATUS FOR TRANSFERRING SMALL AMOUNT OF FLUID

BACKGROUND OF THE INVENTION

The present invention relates to an apparatus for transferring a fluid, such as a pump. More particularly, the invention is concerned with an electromagnetic vibration pump which is adapted for transferring a fluid through a pipe by causing the pipe to vibrate in a manner like respiration.

Various types of pumps have been proposed for the purpose of transferring small amount of fluid. For instance, and electromagnetic pump has been known which has a diaphragm adapted to be vibrated by electromagnetic force so as to displace a small amount of fluid. On the other hand, Japanese Patent Laid-Open Nos. 9679/1981 and 68578/1984 propose a pump in which a cylindrically-shaped vibrator is directly vibrated. The fluid transferring effect in these known pumps relies upon a change in the volume of a chamber by an expansion or contraction of a part of a frame which forms the chamber, and does not necessitate any rotary or sliding parts such as an impeller and a piston. This type of pump, therefore, has a high reliability and is capable of transporting corrosive or highly viscous fluid which can hardly be handled by other types of pumps.

This type of pump, however, essentially requires provision of check valves at the inlet and outlet sides of the pump in order to prevent reversing of the fluid which may otherwise be caused by the periodical change in the volume. Since these check valves open and close in response to the displacement of the fluid, a pulsation is inevitably caused in the pressure of the fluid displaced by the pump. In some uses of the pump, the pulsation in the discharge pressure has to be avoided because it causes various troubles. It is well known that the pulsation of the displaced fluid can be suppressed by a pulsation prevention means such as a pressure accumulator. The use of such a pulsation prevention means, however, raises the cost of the pump system as a whole. According to another method, the vibration for causing the periodic change in the volume is conducted at a high frequency so as to shorten the period of the pulsation to such an extent that the pulsation is materially negligible. This method is advantageous in that it does not necessitate additional provision of any pulsation prevention means, but suffers from a problem in that the check valves which have movable masses cannot operate with good response to such a high frequency of pumping operation. Thus, there is a practical limit in the increase of the vibration frequency in the vibration pump of the kinds described, and it is impossible to shorten the period of pulsation unlimitedly.

SUMMARY OF THE INVENTION

Accordingly, an object of the present invention is to provide a liquid transferring device which is capable of pumping or displacing even a very small amount of fluid, while suppressing pulsation and shortening the period of pulsation to such an extent that the pulsation is materially negligible.

To this end, according to the present invention, there is provided an apparatus for transferring a small amount of fluid which has at least three vibration pump units which are connected in series. Each vibration pump unit has a fluid transfer pipe, a vibrator mounted on the outer peripheral surface of the fluid transfer pipe and adapted to cause the transfer pipe to vibrate in a respiring manner, an inner peripheral electrode on the inner peripheral surface of the vibrator, an outer peripheral electrode on the outer peripheral surface of the vibrator, a high-frequency voltage applying device for applying a high-frequency voltage between the inner peripheral electrode and the outer peripheral electrode thereby causing the vibrator to vibrate in respiring manner, and a fluid diode exhibiting resistance to reversing of the fluid and connected to the fluid outlet of the fluid transfer pipe in such a manner as to permit the fluid to be discharged from the fluid pipe. The adjacent vibration pumps operate at a phase difference which is given by the following formula:

$$\alpha - 2\pi/N$$

where, $\alpha$ represents the phase difference, while N represents the number of the pump units.

Preferably, the apparatus of the invention for transferring small amount of fluid is further equipped with a fluid diode connected to the fluid inlet side of the apparatus in such a manner as to prevent any reversing of the fluid from the apparatus.

DESCRIPTION OF THE PREFERRED EMBODIMENTS

A first embodiment of the apparatus in accordance with the present invention for transferring small amount of fluid will be explained hereinunder with reference to FIGS. 1 to 3.

Figure 1:
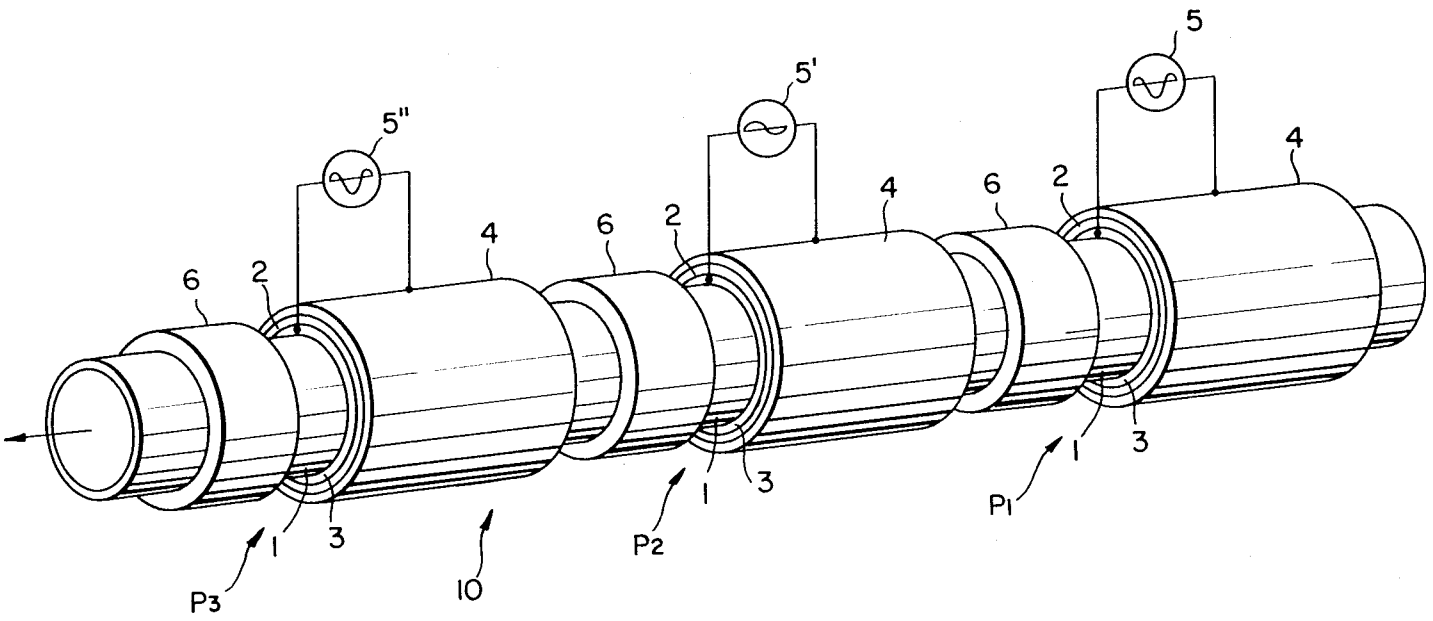
FIG. 1 is a diagrammatic illustration of an apparatus in accordance with the invention for transferring a small amount of a fluid.
Figure 2:
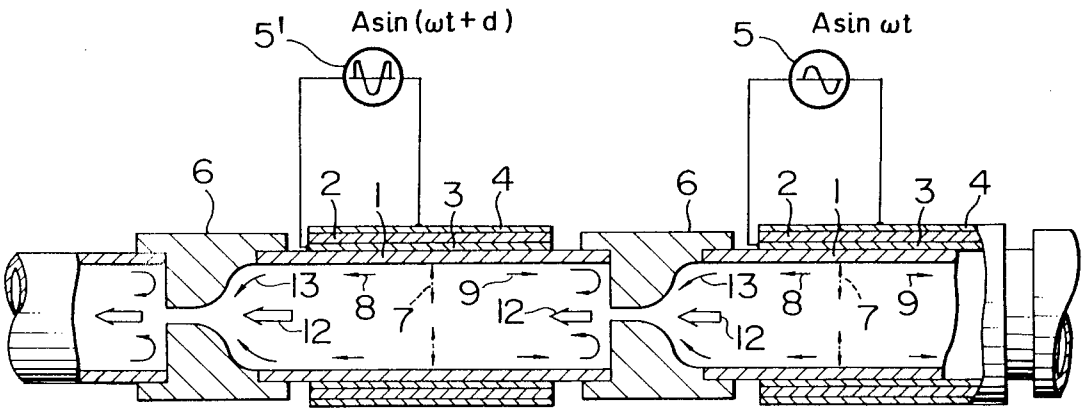
FIG. 2 is a sectional view of the apparatus shown in FIG. 1.

The apparatus for transferring small amount of a fluid, generally designated at a reference numeral 10, includes at least three electromagnetic vibration pump units P which are connected in series in a manner shown in FIG. 1. In FIGS. 1, only two electromagnetic vibration pump units are shown. Each of these pump units includes a cylindrical vibrator 2, which may be constituted by a piezoelectric element, electrostrictive element, magnetostrictive element or other vibration element. The cylindrical vibrator, which is shown to have a length greater than its diameter, is placed so as to surround a fluid transfer pipe 1. The vibrator 2 is covered at its outer and inner peripheral surfaces with an outer peripheral electrode 4 and an inner peripheral electrode 3. These electrodes 3 and 4 which have cylindrical shapes and a comparably shaped cylinder of vibratory material of essentially uniform thickness layered therebetween are connected to a high-frequency power supply 5. A fluid diode 6 is connected to one end of the fluid transfer pipe 1. The fluid diode produces a resistance against reversing of the fluid. In the illustrated embodiment, the fluid diode 6 is of flow nozzle type as shown in FIG. 2. Thus, the fluid transfer pipe 1 of the first pump unit $P_1$ is connected at its one end to the fluid inlet side of the flow nozzle type fluid diode 6. The second pump unit $P_2$ has the fluid transfer pipe 1 which is connected to the fluid outlet side of the above-mentioned fluid diode 6. The second third vibration pump units $P_2$ and $P_3$ have the same construction as the first pump unit $P_1$ so that description thereof is omitted. The second electromagnetic vibration pump unit $P_2$ is connected to a third electromagnetic vibration pump unit $P_3$ as shown in FIG. 1. The fluid inlet of the first electromagnetic vibration pump unit $P_1$ is connected to a fluid reservoir which is not shown.

As high-frequency voltages are applied to the inner and outer peripheral electrodes 3, 4 of each pump unit, the vibrator 2 vibrates in the radial direction in a manner like respiration. This vibration will be referred to as "respiration vibration" throughout the specification. The respiration vibration in each pump unit induces flow of fluid having flow components 8 and 9 in each pump unit. The flow component 8 in the first pump unit $P_1$ causes a flow 13 of the fluid which moves to the left as viewed in FIG. 6 forming streamlines which follow the smooth curvature of the wall defining the inlet side of the fluid diode 6. On the other hand, the flow component 9 in the second pump unit $P_2$ produces a flow of the fluid which is resisted by the fluid diode 6 so as to be turned as denoted by a numeral 11. The flow component 9 in the first pump unit $P_1$ tends to cause a flow which is directed towards the fluid reservoir (not shown) connected to the inlet side of this pump unit $P_1$. This tendency, however, is suppressed by the large mass of fluid in the fluid reservoir. In consequence, the fluid filling the fluid transfer pipe 1 tends to flow in the direction 12 in which it encounters smaller resistance produced by the fluid diode 6. Although in the described embodiment the apparatus 10 for transferring small amount of fluid is directly connected to the fluid reservoir, this arrangement is only illustrative and the apparatus 10 may be connected to the fluid reservoir through another fluid diode 6 which acts to resist the reversing flow of the fluid from the first pump unit $P_1$ back into the fluid reservoir. In this case, the turned flow component 12 produced by the flow component 9 in the first pump unit $P_1$ can be effectively utilized for promoting the unidirectional flow of the fluid. Although not shown, the fluid flows in the third electromagnetic vibration pump $P_3$ in the same manner as that in the second electromagnetic vibration pump unit $P_2$.

The high-frequency power supplies which supply high-frequency voltages to the adjacent pump units have a predetermined phase difference therebetween. It is necessary that this phase difference is determined to meet a predetermined condition, for otherwise the pulsation in the fluid pressure is not suppressed. Namely, according to the present invention, the phase difference $\alpha$ is selected to meet the condition specified by the following formula:

$$\alpha=2\pi/N$$

where N represents the number of the pump units employed in the apparatus of the invention.

The reason why the above-mentioned condition has to be met will be described hereinunder with specific reference to FIG. 3. FIG. 3 shows the pressure distributions developed in the fluid transfer apparatus of the invention having three vibration pumps as obtained when the adjacent pump units are energized at different phase differences of the high-frequency voltages. In order to clearly show the difference in the pressure distribution, pressure distribution in a pipe connected to the fluid transfer apparatus also is shown by broken-line curves. More specifically, curves (a) and (b) in FIG. 3 show the pressure distributions as obtained when the phase difference $\alpha$ is set at $\pi$ at a moment $t=0$ and $t=\pi/3\omega$, respectively. Curves (c) and (d) in FIG. 3 show the pressure distributions as obtained when the phase difference $\alpha$ is set at $\pi/3$ at a moment $t=0$ and $t=\pi/3\omega$, respectively. Curves (e) and (f) in FIG. 3 show the pressure distributions as obtained when the phase difference is set at $2\pi/3$ at a moment $t=0$ and $t=\pi/3\omega$, respectively. From this Figure, it will be understood that a large pressure pulsation with a node fixed at the juncture between vibration pump units is produced when the phase difference $\alpha$ is $\pi$. That is, a pressure pulsation of a frequency corresponding to the frequency of the driving high-frequency voltage is produced in the apparatus, i.e., the pressure pulsation is not suppressed. When the phase difference $\alpha$ is $\pi/3$, the node of the pressure waveform is shifted in the direction X of flow of the fluid. In this case, however, the pressure waveform changes in a random manner. This is not preferred from the view point of suppression of the pressure pulsation. When the phase difference $\alpha$ is $2\pi/3$, the pressure waveform gently proceeds in the direction of flow, such that the peak points of the waveform are shifted in the direction of flow of the fluid. It will be seen also that the pulsation is suppressed in this case. From these facts, it will be understood that the phase difference $\alpha$ is preferably selected to be $2\pi/3$ when the apparatus employs three vibration pump units.

Figure 3:
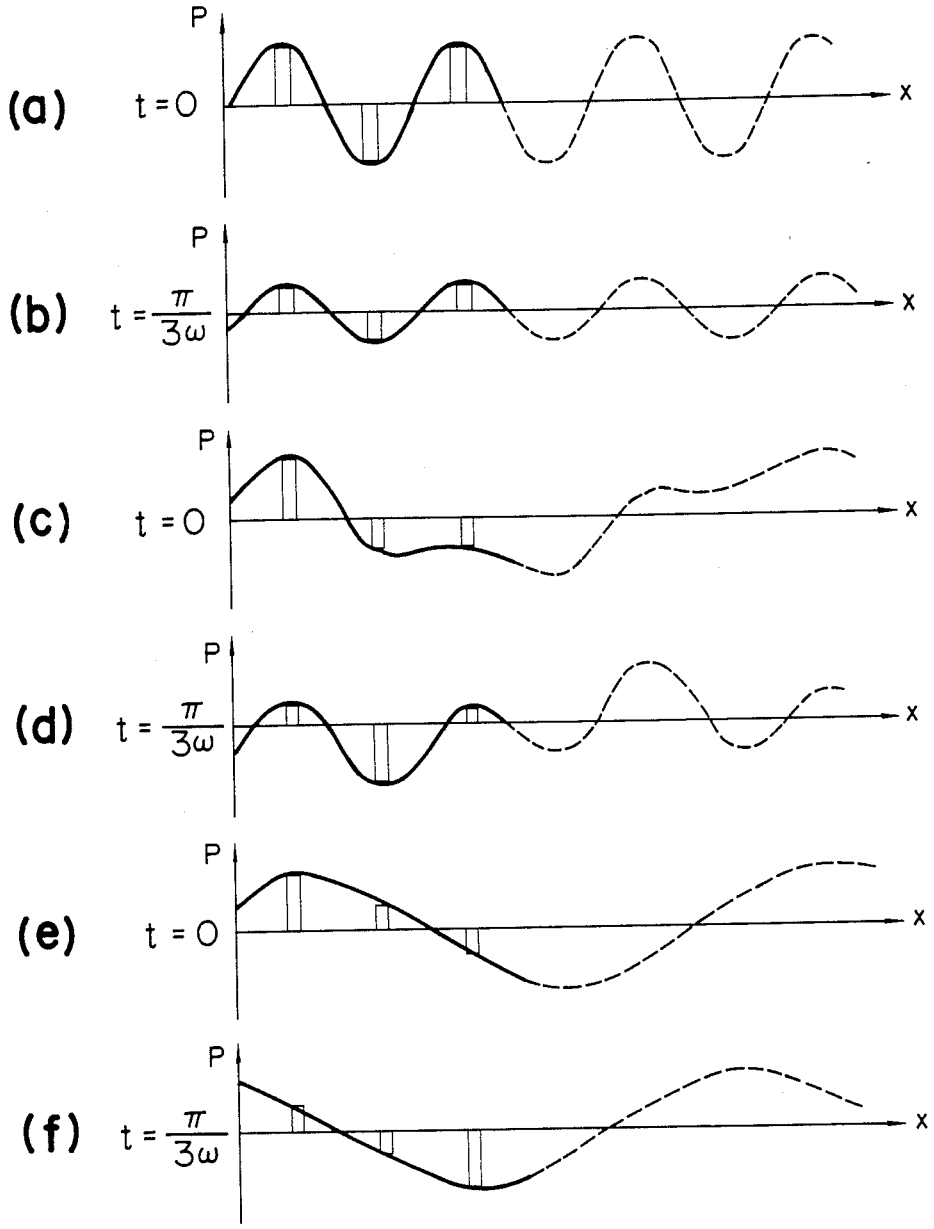
FIG. 3A–3F is a diagram showing the pressure distribution developed in the apparatus of the invention during operation thereof.

When the number of the vibration pump units employed in the apparatus exceeds 3, it is possible to obtain progressive wave as shown by the curves (e) and (f) in FIG. 3, by selecting the phase difference $\alpha$ in accordance with the aforementioned formula.

It is difficult to obtain a progressive wave of pressure when the number of the vibration pump units employed in the apparatus is two.

The phase difference between the high-frequency voltage power supplies may be imparted by a controlling apparatus of the type shown in Japanese patent application No. 159451/1980 or No. 168091/1980.

Figure 4:
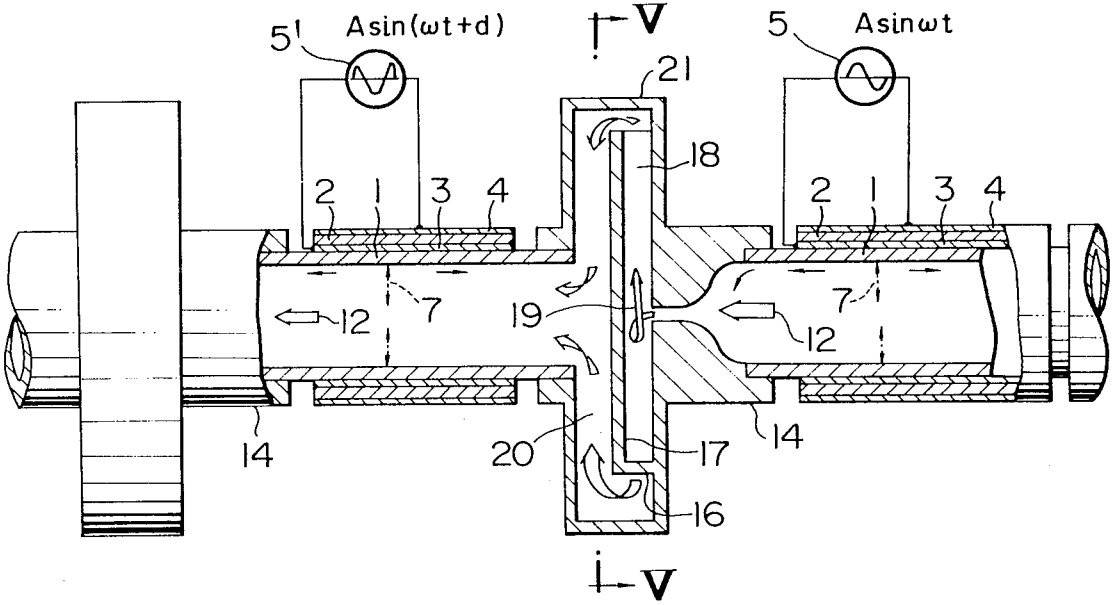
FIG. 4 is a partly-sectioned side elevational view of another embodiment of the apparatus of the present invention.
Figure 5:
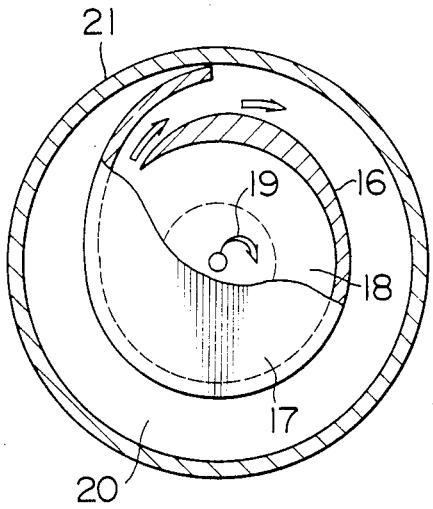
FIG. 5 is a sectional view taken along the line V—V of FIG. 4.

FIGS. 4 and 5 show a second embodiment of the present invention. The second embodiment is different from the first embodiment in that it employs a vortex-flow type diode 21 in place of the flow-nozzle type fluid diode 6 of the first embodiment. The vortex-flow type diode 21 has a flow nozzle 14 having an inlet which is connected to the fluid transfer pipe 1 of the electromagnetic vibration pump unit, a vortex-flow chamber 18 connected to the fluid outlet side of the flow nozzle 14, and a disk-shaped chamber 20 which is connected at its one end to the vortex-flow chamber 18 and at its other end to the fluid inlet of the second electromagnetic vibration pump unit. As will be seen from FIG. 5, the vortex-flow chamber 18 has a vortex guide wall 16 and a partition wall 17 mounted on the vortex wall 16.

As the high-frequency power supply 5 is started, the vibrator 2 on the outer peripheral surface of the fluid transfer pipe 1 vibrates in respiring manner so that a flow 12 of fluid is induced in the fluid transfer pipe as in the case of the first embodiment. The flow 12 of the fluid enters the flow nozzle 14 and then the vortex chamber 18 so as to flow along the vortex wall 16 thus forming a vortex flow 19 of the fluid. The fluid in the form of the vortex flow 19 then flows into the chamber 20 and then into the fluid transfer pipe of the second vibration pump unit. The vortex-flow type fluid diode 21 has a function to resist any reverse flow of the fluid from the downstream side. Namely, the vortex guide wall produces a large resistance to the reversing flow of fluid from the downstream or outlet side. In addition, the fluid encounters a very large resistance when it flows from the vortex chamber 18 back into the flow nozzle 14, due to a drastic contraction of the flow passage and a drastic change in the flowing direction. Thus, the vortex-flow type fluid diode exhibits a superior diode characteristics so as to enable the fluid transfer apparatus of the invention to produce a large delivery head.

Figure 7:
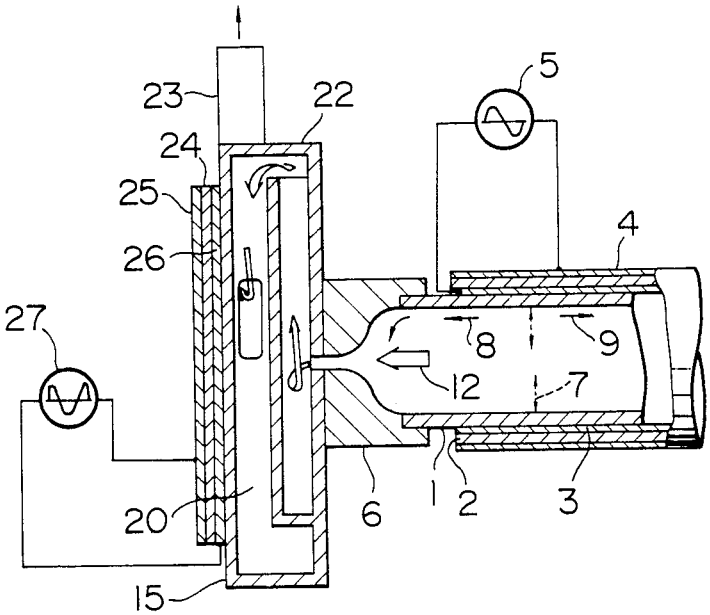
FIG. 7 is a sectional view of the embodiment shown in FIG. 6.
Figure 6:
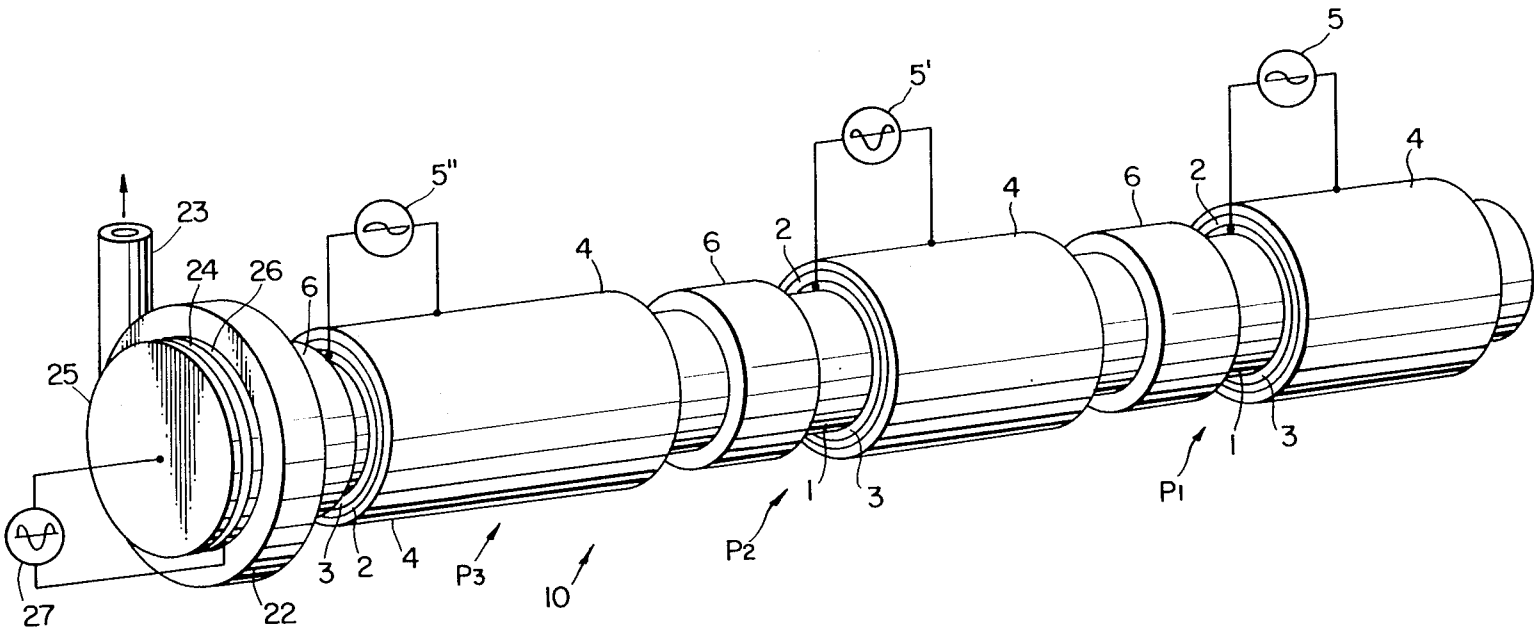
FIG. 6 is a diagrammatic illustration of still another embodiment of the apparatus of the present invention.

FIGS. 6 and 7 in combination show a third embodiment of the present invention. The third embodiment features a fluid diode 22 similar to the vortex-flow type fluid diode used in the second embodiment and connected to the downstream end of an apparatus which is substantially the same as the first embodiment. The fluid diode 22 is materially the same as the vortex-flow type fluid diode 21 used in the second embodiment except that its fluid outlet 23 is arranged to extend in the tangential direction. In the third embodiment, a disk-shaped vibrator 24 is mounted on the outer wall 15 of the vortex-flow type fluid diode 22. The vibrator 24 is covered at its side adjacent the wall 15 by an inner electrode 26 and its side remote from the wall 15 by an outer electrode 25. A high-frequency voltage applying device 27 is connected between the outer and inner electrodes 25 and 26.

In this embodiment, the flow 12 of the fluid induced by the respiration vibration 7 of the upstream fluid transfer pipe 1 is introduced into the fluid diode 22 through the flow-nozzle type fluid diode. The vibrator 24 provided on the outer wall 15 of the fluid diode 22 vibrates the outer wall 15 with a phase difference determined in accordance with the formula mentioned before, so that the chamber performs respiration vibration. The respiration vibration of the chamber 20 further accelerates the fluid, thus attaining a higher delivery head of the apparatus.

As will be understood from the foregoing description, according to the present invention, fluid diodes which produce large resistance to reversing of the fluid are employed. Since any movable parts such as check valves are not used, it is possible to vibrate the vibrator at a high frequency. This in turn enables the period of the pulsation remarkably to such an extent that the pulsation is materially negligible. Furthermore, since at least three vibration pump units constituting the fluid transfer apparatus can, perform respiration vibration, the pulsation of the fluid can be reduced remarkably. In addition, the apparatus of the present invention can operate with a distinguished reliability because it does not have any parts which slide or rotate. Moreover, the pumping rate can be controlled without difficulty through a control of the frequency of the high-frequency voltage for causing the vibrator to vibrate.

What is claimed is:

1. An apparatus for transferring a small amount of fluid comprising:

at least three vibration pump units which are connected in series along an axis, each of said vibration pump units having a fluid transfer pipe, a peripheral vibrator mounted on the outer peripheral surface of the fluid transfer pipe and adapted to cause said transfer pipe to vibrate in a respiring manner, an inner peripheral electrode on the inner peripheral surface of said peripheral vibrator and having a major dimension extending parallel to said axis, an outer peripheral electrode on the outer peripheral surface on said vibrator and covering the inner peripheral electrode, said peripheral vibrator being positioned between said inner and outer electrodes, a high-frequency voltage applying device for applying a high-frequency voltage between said inner peripheral electrode and said outer peripheral electrode thereby causing the peripheral vibrator to vibrate in respiring manner, a fluid diode exhibiting resistance to reversing of the fluid and connected to the fluid outlet of each fluid transfer pipe in such a manner as to permit the fluid to be discharged from each fluid transfer pipe, said high-frequency voltage applying devices of the adjacent vibration pump units being operated with a predetermined phase difference therebetween.

2. An apparatus according to claim 1, wherein said phase difference between said high-frequency voltage application devices of the adjacent vibration pump units is determined to meet the following condition:

$$\alpha = 2\pi/N$$

where, $\alpha$ represents the phase difference, while N represents the number of the pump units.

3. An apparatus according to claim 1, further comprising a fluid diode connected to the fluid inlet side of said apparatus in such a manner as to prevent any reversing of the fluid from said apparatus.

4. An apparatus according to claim 1, wherein said fluid diode is a flow nozzle type diode.

5. An apparatus according to claim 1, wherein said fluid diode is a vortex-flow type fluid diode which includes a flow-nozzle type flow passage and a vortex flow chamber connected to a small-diameter portion of said flow-nozzle type flow passage.

6. An apparatus according to claim 1, wherein said peripheral vibrator includes a piezoelectric element.

7. An apparatus according to claim 1, wherein said vibrator includes an electrostrictive element.

8. An apparatus according to claim 1, wherein said vibrator includes a magnetostrictive element.

9. An apparatus according to claim 1, wherein said vibrator comprises a cylindrically shaped layer of vibratory material having a wall thickness that is essentially uniform, said cylindrical wall being positioned between said inner and outer peripheral electrode, the length of said vibratory material layer as measured along said pump axis being greater than the distance between opposite side walls as measured in a plane perpendicular to said pump unit axis.

10. An apparatus for transferring a small amount of fluid comprising:

at least three vibration pump units which are connected in series along an axis, each of said vibration pump units having a fluid transfer pipe, a peripheral vibrator mounted on the outer peripheral surface of the fluid transfer pipe and adapted to cause said transfer pipe to vibrate in a respiring manner, an inner peripheral electrode on the inner peripheral surface of said peripheral vibrator and having a major dimension extending parallel to said axis, an outer peripheral electrode on the outer peripheral surface on said peripheral vibrator and covering the inner peripheral electrode, said peripheral vibrator being positioned between said inner and outer electrodes, a high-frequency voltage applying device for applying a high-frequency voltage between said inner peripheral electrode and said outer peripheral electrode thereby causing the peripheral vibrator to vibrate in respiring manner, a fluid diode exhibiting resistance to reversing of the fluid and connected to the fluid outlet of said fluid transfer pipe in such a manner as to permit the fluid to be discharged from said fluid pipe, said high-frequency voltage applying devices of the adjacent vibration pump units being operated with a predetermined phase difference therebetween, and a vibration fluid diode connected to a final fluid outlet of said at least three vibration pump units, said vibration fluid diode being a vortex-flow type fluid diode having a vortex chamber therein including an outer wall vibrator provided on the outer wall of the vortex chamber, an outer electrode on the outer surface of said outer wall vibrator, an inner electrode on the inner surface of said outer wall vibrator and a high-frequency voltage application device for applying a high-frequency voltage between said outer electrode and said inner electrode so as to cause said outer wall vibrator to vibrate.

* * * * *